US005171053A

United States Patent [19]

Rouleau

[11] Patent Number: 5,171,053

[45] Date of Patent: Dec. 15, 1992

[54] BARREL CLAMP

[75] Inventor: Gilles Rouleau, Sault St. Marie, Canada

[73] Assignee: Ro-Von Steel Ltd., Saul Ste Marie, Canada

[21] Appl. No.: 877,773

[22] Filed: May 4, 1992

[30] Foreign Application Priority Data

May 15, 1991 [CA] Canada ..... 2042647

[51] Int. Cl.[5] ..... B66C 1/66

[52] U.S. Cl. ..... 294/106; 294/90

[58] Field of Search ..... 294/16, 28, 31.1, 62, 294/67.31, 81.51, 81.61, 90, 104, 106, 108, 109, 110.1, 111-113, 117, 118

[56] References Cited

U.S. PATENT DOCUMENTS

| | | | |
|---|---|---|---|
| 270,158 | 1/1883 | Van Patten | 294/90 X |
| 384,107 | 6/1888 | Wiley | 294/110.1 |
| 1,350,053 | 8/1920 | Awischus | 294/109 |
| 1,966,240 | 7/1934 | Erdahl | 294/106 X |
| 2,327,005 | 8/1943 | Babcock et al. | 294/106 |
| 2,617,678 | 11/1952 | Kelso . | |
| 2,758,869 | 8/1956 | Shaw | 294/106 X |
| 3,273,931 | 9/1966 | Caldwell et al. | 294/106 |
| 3,352,591 | 11/1967 | Casey | 294/106 |
| 3,790,204 | 2/1974 | Lighthipe et al. | 294/110.1 |

FOREIGN PATENT DOCUMENTS

| | | |
|---|---|---|
| 146414 | 2/1913 | Canada . |
| 185641 | 6/1918 | Canada . |
| 193402 | 10/1919 | Canada . |
| 581442 | 8/1959 | Canada . |
| 606645 | 10/1960 | Canada . |
| 663432 | 5/1963 | Canada . |
| 675419 | 12/1963 | Canada . |
| 847754 | 7/1970 | Canada . |
| 1201140 | 2/1986 | Canada . |

*Primary Examiner*—Johnny D. Cherry

*Attorney, Agent, or Firm*—Dressler, Goldsmith, Shore, Sutker & Milnamow, Ltd.

[57] ABSTRACT

There is disclosed a lifting device particularly suited for lifting plastic drums or barrels while maintaining the same vertically upright and transporting the same to another location. The lifting device is unique in that it employs a locking bar which is capable of locking the device in both the open position preparatory for securing the barrel, and the grasping/lifting position. It maintains either of these locked positions regardless of whether an upward force is exerted upon the pair of pivotal tongs. Unlike other pivoted lifting devices or tongs, the present invention uses a minimal amount of friction force to lift a barrel, such that the fragile resilient sides of a plastic barrel are not damaged.

7 Claims, 2 Drawing Sheets

BARREL CLAMP

This invention relates to lifting devices and more particularly, a lifting device adapted to lift and transport a plastic barrel or drum.

BACKGROUND

In the past, industrial chemicals, lubricants, oils and fuels, solvents, and other liquids have been packed in durable steel drums. Such drums can withstand extreme forces or friction exerted upon their curved side walls when lifting devices with pivotal grasping means are used to move the same. The rigid metal sides of such containers, particularly when filled with fluid or liquid, are built to withstand extreme friction force pressure.

Nowadays, many lubricants, chemicals and other fuels, are packed in plastic drums. Plastic drums are inexpensive to manufacture, resistant to rusting, cleaner to handle, and have a longer life. Unfortunately, plastic drums suffer one particular drawback. Such drums are fragile and have relatively resilient flexible sides compared to steel drums. Moreover, such barrels are easily punctured.

Previous lifting devices such as that described in Canadian Patent 606,745, are quite suitable for grasping and vertically lifting such things as heavy rolls of paper or steel cylinders. The extreme friction or force required to grasp and hold a pair of tongs firmly about the cylindrical sides of a roll of paper does not damage these items.

If one employs a device as shown in CP 606,745 (where the friction against the side walls is increased as the lifting force is increased) to lift a plastic drum, the result may be the caving-in and puncturing of the drum's relatively fragile sides.

It is therefore an object of the present invention to provide a lifting device for grasping and lifting plastic barrels without damaging the sides thereof.

It is a further object of the present invention to provide a device which can be both manually locked in a grasping/lifting/holding position and in an open position.

It is a further object of the present invention to provide a device which when secured and locked about a barrel, and an upward force is applied, the force is exerted upwardly below the lip of the top of the barrel rather than inwardly by means of friction on the sides of the barrel.

SUMMARY OF THE INVENTION

Therefore, this invention seeks to provide a device for handling and transporting barrels comprising: a pair of pivotally mounted tongs mounted adjacent each end of at least one tie-bar; each of said tongs including a grasping means at its lower end adapted to grasp a barrel below its upper rim; a locking arm and a first clevis pivotally mounted to an upper end of one of said tongs; a second clevis pivotally mounted by a horizontally disposed pin to an upper end of a second of said tongs; said locking arm including at least two indentations on its lower side, either of said indentations being adapted to engage said horizontally disposed pin of said second clevis in a locked position; wherein, when in operation, one of said indentations of said locking arm is engaged on said horizontally disposed pin, said tongs are locked in an open position; and when another of said indentations is engaged on said horizontally disposed pin, said tongs are locked in a grasping/lifting position, regardless of any upward force exerted on said device.

Briefly, the device is comprised of a pair of pivotal tongs which pivot about one or more elongate tie-bars. Attached to the bottom of the tie-bars are a pair of centering bung retainers. At the lower ends of the tongs are a pair of arc-shaped grasping means which are adapted to fit about the sides of a barrel. The device can be made in numerous sizes and, accordingly, the arc of curvature of the grasping means can be changed, depending upon the size of barrel to be lifted. On the top end of one of the tongs is pivotally mounted a clevis and a locking arm. In a preferred embodiment the locking arm has two notches on its underside. These notches are adapted to fit over a horizontally disposed clevis pin which pivotally attaches a clevis to the top end of the opposite tong. Attached to the two clevises is a lifting ring adapted for connection to a crane or other lifting device.

In operation, the left hand notch of the locking handle is placed over the right hand clevis pin and the device is moved into position on top of a drum which rests vertically on its end. The bung retainers help to center the device in the immediate center of the top of the drum to be lifted as the bung retainers are adapted to fit within the upwardly extending circumferential lip of a plastic drum. The arc-shaped grasping means are adapted to fit below the lip around a circumferential indentation on the barrel.

When the device is in the proper position, an operator manually moves the lifting handle and secures the right hand notch of the handle over the pivot pin of the right hand clevis. At that point in time, the lifting device is locked in the grasping/lifting position. Once the lifting handle is locked with the right hand notch on the right hand pivot pin, the device will not move from the barrel regardless of whether or not upward pressure is exerted upon the lifting ring.

Once the device is in the grasping/lifting position, a crane lifts the device and the barrel in a vertically upward position and moves it to another desired place.

Even after the drum is set down, the device maintains itself in the locking grasping position.

The device is particularly suited for moving drums which are open and have a certain amount of liquid or solid therein. When the device lifts such drums, it keeps them perfectly vertically upright, avoiding any spillage. If the drum is lowered down to a temporary position on the floor, the device maintains its locking grasp on the drum and avoids any possibility of the drum tipping or being moved out of the vertical position.

BRIEF DESCRIPTION OF THE DRAWINGS

The invention is more clearly described in conjunction with the following drawings wherein.

DETAILED DESCRIPTION OF THE INVENTION

Figure 1:
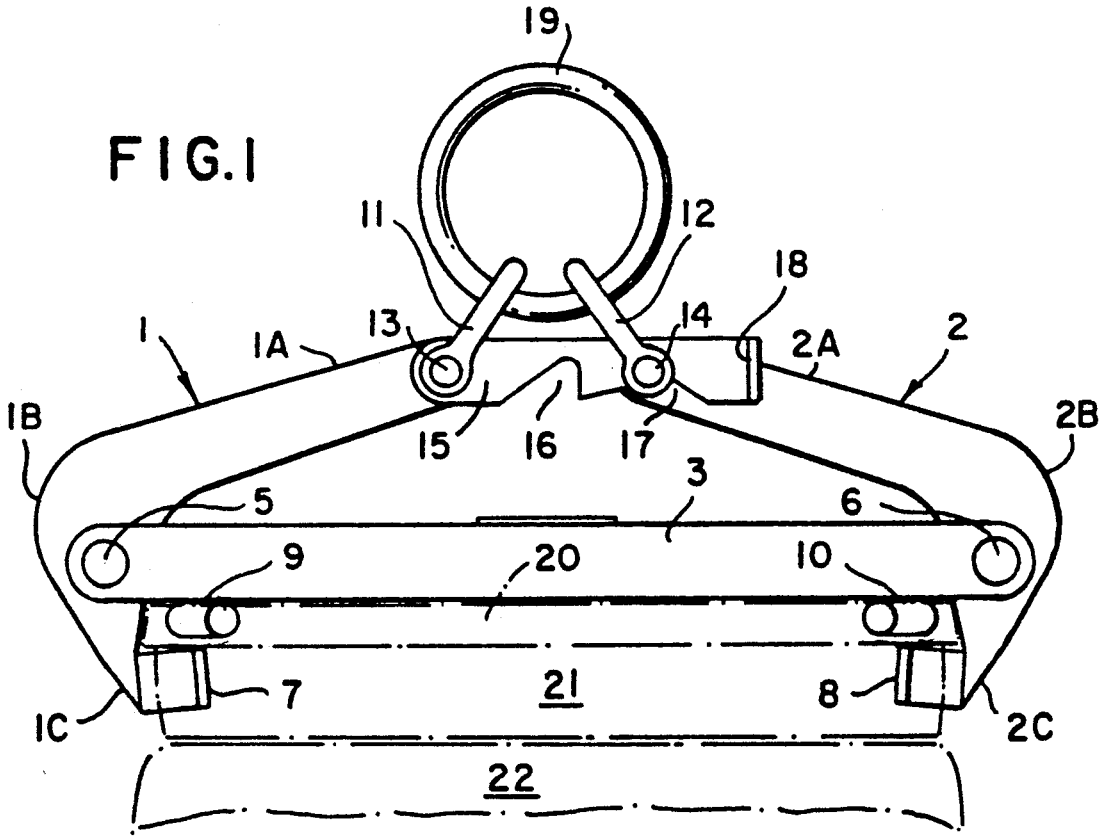
FIG. 1 is a side view of the lifting device in the locked lifting/grasping position with a barrel in outline secured therein.

In FIG. 1 the lifting device of the present invention is in the grasping/lifting locked position. The lifting device is comprised of a left hand tong 1, having an elongate upper portion 1A, a curved enlarged central portion 1B and a lower grasping portion 1C. The right hand tong 2 is similarly comprised of an upper elongate portion 2A, a curved enlarged mid-portion 2B and a lower grasping portion 2C. The tongs 1 and 2 are pivotally mounted between a pair of elongate tie-bars 3 and 4 (see FIGS. 3 and 4); tong 1 pivoting about pivot 5 and tong 2 pivoting about pivot 6. Pivots 5 and 6 are located in the curved enlarged mid-portions 1B and 2B, respectively.

Fixedly attached on each of the bottom portions 1C and 2C of the tongs 1 and 2 are horizontally disposed arc-shaped barrel grasping portions 7 and 8, respectively. The curvature of these portions is the same as the curvature of the outside of the drums to be picked up. Moreover, the curvature of portions 7 and 8 can be changed depending upon the size and diameter of the drums to be lifted.

Fixedly attached on the underside of the tie-bars 3 and 4 are a pair of bung retainers 9 and 10, which are adapted to fit inside an upwardly extending circumferential lip 20 of a drum 21 and to rest on the top end of said drum.

Pivotally attached to the top end 1A of tong 1, on a horizontal pivot pin 13, is a clevis 11 and a locking arm 15. The locking arm 15 is aligned in the vertical and has an horizontally extending handle 18 at one end. In addition, in a preferred embodiment, there are two notches 16 and 17 on the underside of lifting arm 15. These are adapted to fit over the horizontally disposed pivot pin 14 of clevis 12. Clevis 12 is pivotally attached to the upper end 2A of right hand tong 2. Both clevises 11 and 12 are threaded through a common lifting ring 19.

Figure 2:
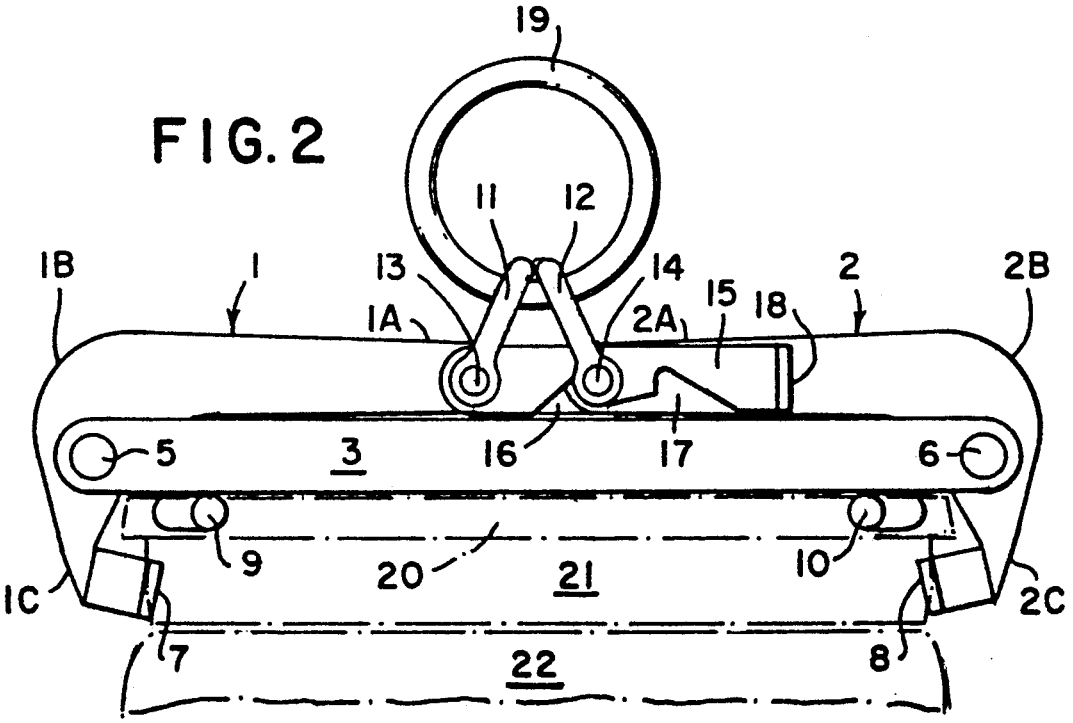
FIG. 2 is a perspective side view of the lifting device in the open/locked position.
Figure 4:
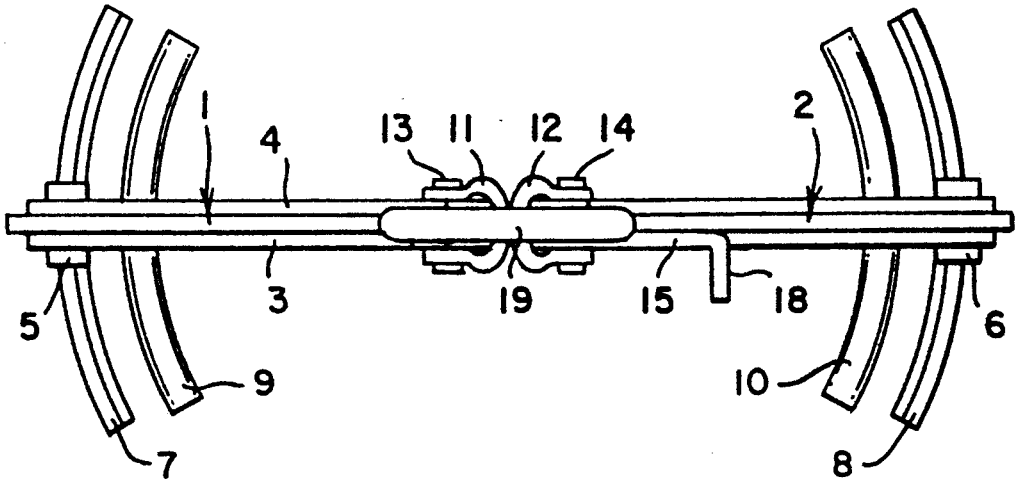
FIG. 4 is a top view of the device in the open position.

In operation, the lifting device of the present invention is attached to a crane (not shown) by means of its lifting ring 19. The device is then moved into position on top of a drum 21 in the open position as shown in FIGS. 2 and 4. Bung retainers 9 and 10 come to rest upon the top of the drum 21 inside the upper lip 20 thereof and arc-shaped barrel grasping portions 7 and 8 are secured below the lip 20 around indentation 22 of the drum 21.

Figure 3:
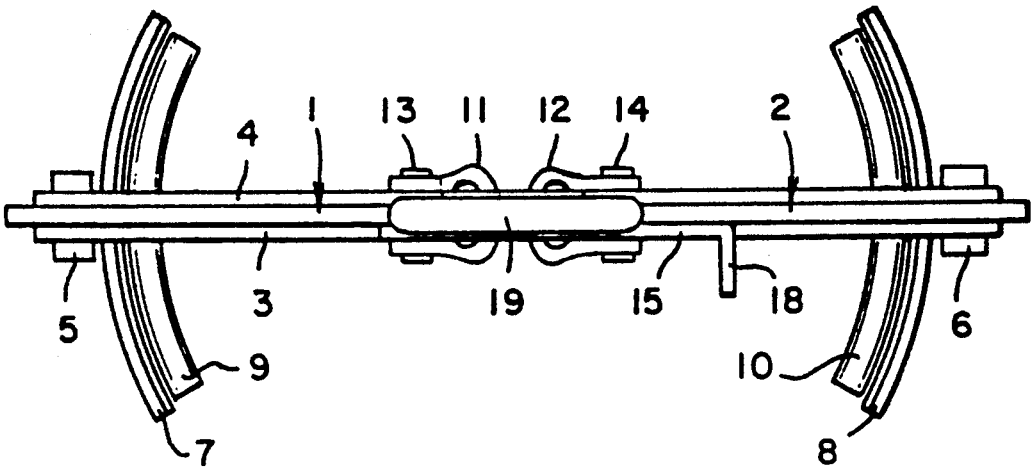
FIG. 3 is a top view of the lifting device in the holding grasping position.

Thereafter, locking arm 15 is raised and notch 17 is manually lockably secured over horizontal pin 14 of clevis 12. The device is then locked in the lifting/grasping position as shown in FIGS. 1 and 3, and cannot be removed without manually lifting the handle 18 of locking arm 15.

Thereafter, an upward force is applied to lifting ring 19 and the barrel 21 is lifted in a vertical position to a desired location. When the barrel has been moved to its end destination, the crane or suitable lifting mechanism relaxes the pressure on lifting ring 19 and is detached therefrom. Because notch 17 is lockably secured over pivot pin 14, the device is maintained in the lifting/grasping position around indentation 22 of barrel 2. The device will not move from that position until an operator lifts the handle 18 and places notch 16 over horizontal pin 14. This action causes arc-shaped grasping/lifting portions 7 and 8 to be outwardly disposed and the device is free to be placed over another drum, while maintaining its locked open position as shown in FIGS. 2 and 4.

Although a particular embodiment of the invention is illustrated, it is understood that many variations are possible without departing from the spirit of the invention.

What I claim as my invention is:

1. A device for handling and transporting barrels comprising:

a pair of pivotally mounted tongs mounted adjacent each end of at least one tie-bar;

each of said tongs including a grasping means at its lower end adapted to grasp a barrel below its upper rim;

a locking arm and a first clevis pivotally mounted to an upper end of one of said tongs;

a second clevis pivotally mounted by a horizontally disposed pin to an upper end of a second of said tongs;

said locking arm including at least two indentations on its lower side, either of said indentations being adapted to engage said horizontally disposed pin of said second clevis in a locked position;

wherein when, in operation, one of said indentations of said locking arm is engaged on said horizontally disposed pin, said tongs are locked in an open position; and when another of said indentations is engaged on said horizontally disposed pin, said tongs are locked in a grasping/lifting position, regardless of any upward force exerted on said tongs.

2. A device as claimed in claim 1 wherein said tongs are pivotally mounted between two tie-bars.

3. A device as claimed in claim 2 wherein a pair of horizontally disposed bung retainers are fixedly attached to the underside of said tie-bars;

said bung retainers being adapted to rest firmly against the top of a barrel when said device is in the grasping/lifting position.

4. A device as claimed in claim 3 wherein said bung retainers are arc-shaped and positioned on said tie-bars, such that in operation said bung retainers are adapted to lie adjacent an upwardly protruding circumferential lip located on the top end of a barrel when said device is in the open position, such that said bung retainers are adapted to center said device on the top end of said barrel.

5. A device as claimed in claim 4 wherein when said device is lockably secured to a barrel in a grasping/lifting position, it remains locked thereto, regardless of whether a lifting force is applied to said device.

6. A device as claimed in claim 1 wherein said first and second clevis pins are connected to a common lifting ring.

7. A device as claimed in claim 1 wherein said grasping means comprises arc-shaped members adapted to firmly fit about the circumference of a barrel below the upper rim thereof when in the grasping/lifting position.

* * * * *